US008646293B2

(12) United States Patent
Chang

(10) Patent No.: US 8,646,293 B2
(45) **Date of Patent: *Feb. 11, 2014**

(54) DRUM TYPE WASHING MACHINE

(75) Inventor: Jae-Won Chang, Gunpo (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/985,389

(22) Filed: Jan. 6, 2011

(65) Prior Publication Data

US 2011/0094272 A1 Apr. 28, 2011

Related U.S. Application Data

(63) Continuation of application No. 12/639,872, filed on Dec. 16, 2009, now Pat. No. 7,930,910, which is a continuation of application No. 12/267,457, filed on Nov. 7, 2008, which is a continuation of application No. 10/461,451, filed on Jun. 16, 2003, now Pat. No. 7,533,548.

(30) Foreign Application Priority Data

Dec. 27, 2002 (KR) ..... 10-2002-0085521

(51) Int. Cl.
*D06F 37/22* (2006.01)
*D06F 37/26* (2006.01)

(52) U.S. Cl.
USPC ..... 68/23.1; 68/24

(58) Field of Classification Search
USPC ..... 68/140, 24, 58, 23.1
See application file for complete search history.

(56) References Cited

U.S. PATENT DOCUMENTS

| | | | | |
|---|---|---|---|---|
| 912,038 | A | 2/1909 | Seifert | |
| 1,077,043 | A | 10/1913 | Darrow | |
| 1,470,245 | A | 10/1923 | Slider | |
| 1,611,865 | A | 12/1926 | Ahlm | |
| 1,611,895 | A | 12/1926 | Dienner | |
| 1,657,181 | A | 1/1928 | Sando | |
| 1,787,427 | A | 1/1931 | Eckhard | 68/140 |
| 2,033,630 | A | 3/1936 | Gould | |

(Continued)

FOREIGN PATENT DOCUMENTS

| | | |
|---|---|---|
| CN | 2423308 Y | 3/2001 |
| CN | 1293276 | 5/2001 |

(Continued)

OTHER PUBLICATIONS

European Patent Office 0 212 259 Mar. 1987.*

(Continued)

*Primary Examiner* — Joseph L Perrin
(74) *Attorney, Agent, or Firm* — KED & Associates, LLP

(57) ABSTRACT

A drum type washing machine is provided. The drum type washing machine may include a cabinet, a tub fixed to an inner side of the cabinet, a drum rotatably arranged in the tub, and a driving motor positioned at a rear side of the drum for generating a driving force that rotates the drum. The washing machine may also include a supporting plate to rotatably support a rotational shaft extending between the motor and the drum, and a plurality of supporters connected between the supporting plate and the cabinet. Such an arrangement may increase washing capacity by increasing a diameter of the drum without increasing an external size of the cabinet.

20 Claims, 9 Drawing Sheets

(56) References Cited

U.S. PATENT DOCUMENTS 2,089,066 A 8/1937 Morrill ..... 248/26
2,096,649 A 10/1937 Rasanen
2,152,458 A 3/1939 Bergman ..... 172/36
2,153,418 A 4/1939 Haberstump ..... 286/5
2,156,992 A 5/1939 Knapp
2,165,884 A 7/1939 Chamberlin et al. ..... 8/159
2,191,607 A 2/1940 Chamberlin et al. ..... 237/20
2,217,351 A 10/1940 Soderquist
2,225,144 A 12/1940 Bassett, Jr.
2,230,345 A 2/1941 Bradbury
2,278,911 A 4/1942 Breckenridge
2,296,257 A 9/1942 Breckenridge ..... 68/24
2,296,261 A 9/1942 Breckenridge et al. ..... 68/24
2,296,267 A 9/1942 Baird ..... 68/23
2,323,765 A 7/1943 Haberstump ..... 68/13
2,331,897 A 10/1943 Dyer
2,356,816 A 8/1944 Breckenridge et al. ..... 68/12
2,356,818 A 8/1944 Bruckman ..... 68/24
2,389,774 A 11/1945 Haberstump ..... 220/10
2,408,509 A 10/1946 Clark ..... 68/23
2,434,476 A 1/1948 Wales ..... 68/19
2,498,181 A 2/1950 Reiter ..... 259/81
2,509,516 A 5/1950 Murphy ..... 29/215
2,510,836 A 6/1950 Russell et al. ..... 68/24
2,521,578 A 9/1950 Haberstump ..... 68/19
2,526,002 A 10/1950 Brotman ..... 68/140
2,526,048 A 10/1950 Russell ..... 68/24
2,526,444 A 10/1950 Woodson
2,527,239 A 10/1950 Woodson ..... 68/23
2,541,166 A 2/1951 Leef ..... 68/140
2,542,509 A 2/1951 Goriup ..... 68/153
2,555,269 A * 5/1951 Chamberlin ..... 68/140
2,556,490 A 6/1951 Chamberlin ..... 8/159
2,565,604 A 8/1951 Geiger ..... 68/140
2,579,472 A * 12/1951 Chamberlin et al. ..... 68/23.1
2,579,836 A 12/1951 Lee et al. ..... 260/26
2,589,284 A 3/1952 O'Neil ..... 34/77
2,593,752 A 4/1952 Haberstump ..... 68/61
2,615,320 A 10/1952 Belaieff ..... 68/24
2,620,070 A 12/1952 Dodge ..... 210/365
2,629,245 A 2/1953 Chamberlin
2,634,595 A 4/1953 Olson
2,644,326 A * 7/1953 Worst ..... 68/23.5
2,652,708 A 9/1953 Rimsha et al.
2,656,700 A 10/1953 Smith ..... 68/23
2,664,326 A 12/1953 Kuzmick
2,711,297 A 6/1955 Thiele ..... 248/18
2,717,135 A 9/1955 Douglas ..... 248/20
2,737,799 A 3/1956 Knipmeyer
2,757,531 A 8/1956 Fox
2,758,685 A 8/1956 Sisson ..... 192/3.5
2,774,621 A 12/1956 Kilbourne, Jr. ..... 228/23
2,785,557 A 3/1957 Stilwell, Jr. ..... 68/12
2,836,046 A 5/1958 Smith ..... 68/24
2,843,314 A 7/1958 Hansen ..... 230/232
2,844,225 A 7/1958 Hubbard et al.
2,844,255 A 7/1958 Cavenah et al.
2,859,877 A * 11/1958 Sisson ..... 210/365
2,873,599 A 2/1959 Buechler ..... 68/24
2,882,706 A 4/1959 Brucken ..... 68/23
2,893,135 A 7/1959 Smith
2,895,319 A 7/1959 Rochefort ..... 68/3
2,908,871 A 10/1959 McKay ..... 331/108
2,930,217 A 3/1960 Rehmke ..... 68/24
2,937,516 A 5/1960 Czaika
2,957,330 A 10/1960 Cline
2,959,966 A 11/1960 Bochan
2,972,877 A 2/1961 Platt ..... 68/18
2,975,528 A 3/1961 Shewmon
2,981,094 A 4/1961 Lehmann et al.
2,984,094 A 5/1961 Belaieff ..... 68/24
2,986,914 A 6/1961 Brucken ..... 68/12
2,987,190 A 6/1961 Bochan
2,990,706 A 7/1961 Bochan ..... 68/12
2,995,023 A * 8/1961 Douglas ..... 68/131
2,995,918 A 8/1961 Neidenthal et al.
2,987,189 A 9/1961 Evjen
3,048,026 A * 8/1962 Bochan et al. ..... 68/12.09
3,058,331 A 10/1962 Anthony
3,066,522 A * 12/1962 Steinmuller ..... 68/23.2
3,073,668 A 1/1963 Rothenberger
3,089,326 A 5/1963 Belaieff ..... 68/24
3,098,581 A 7/1963 Marsilio ..... 220/46
3,135,688 A 6/1964 Compans et al.
3,153,951 A 10/1964 Whelan ..... 74/665
3,178,916 A 4/1965 Belaieff et al. ..... 68/24
3,197,983 A 8/1965 Ilmer ..... 68/24
3,206,267 A 9/1965 Gruner et al. ..... 312/228
3,248,908 A 5/1966 Pope
3,257,830 A 6/1966 Shelton ..... 68/133
3,273,361 A 9/1966 Smith ..... 68/12
3,280,603 A 10/1966 Schwamm
3,333,444 A 8/1967 Bochan ..... 68/208
3,356,222 A 12/1967 Belaieff ..... 210/363
3,362,198 A 1/1968 Barito
3,389,881 A 6/1968 Stelwagen ..... 248/18
3,391,469 A 7/1968 Reeder ..... 34/58
3,459,461 A 8/1969 Bannon, Jr. ..... 213/214
3,477,259 A 11/1969 Barnish et al. ..... 68/23.1
3,503,228 A 3/1970 Lake
3,509,742 A 5/1970 Bauer ..... 68/23.1
3,531,954 A 10/1970 Krupsky ..... 68/18
3,742,738 A 7/1973 Frotriede
3,783,653 A 1/1974 Haerick
3,799,348 A 3/1974 Mazza
3,927,542 A 12/1975 de Hedouville ..... 68/17
3,952,557 A 4/1976 Bochan
4,114,406 A 9/1978 Horowitz et al. ..... 68/24
4,295,387 A 10/1981 Zhivotov et al. ..... 74/573
4,321,302 A 3/1982 Umeki et al.
4,327,302 A 4/1982 Hershberger
4,412,390 A 11/1983 Grant ..... 34/58
4,437,325 A 3/1984 Hershberger
4,446,706 A 5/1984 Hartwig ..... 68/24
4,498,181 A 2/1985 Menown et al. ..... 372/38
4,618,193 A 10/1986 Cuthbert et al. ..... 312/264
4,771,253 A 9/1988 Sasaki et al.
4,819,460 A 4/1989 Obradovic ..... 68/23.7
4,989,684 A 2/1991 Conaway ..... 180/89.15
5,038,586 A 8/1991 Nukaga et al. ..... 68/12.01
5,080,204 A 1/1992 Bauer et al. ..... 188/129
5,199,690 A 4/1993 Marshall ..... 267/64.25
5,209,458 A 5/1993 Eubank et al. ..... 254/88
5,230,229 A 7/1993 Stadelmann et al. ..... 68/23.1
5,267,456 A 12/1993 Nukaga et al. ..... 68/12.24
5,280,660 A 1/1994 Pellerin et al. ..... 8/158
5,381,677 A 1/1995 Park et al.
5,433,091 A 7/1995 Durazzani et al.
5,442,937 A 8/1995 Kwon
5,526,657 A * 6/1996 Johnson ..... 68/3 R
5,546,772 A 8/1996 Merlin et al.
5,548,979 A 8/1996 Ryan et al.
5,570,597 A 11/1996 Bongini et al.
5,657,649 A 8/1997 Lim ..... 68/23.3
5,678,430 A 10/1997 Merlin et al.
5,711,170 A 1/1998 Johnson ..... 68/3
5,711,171 A 1/1998 Uhlin ..... 68/4
5,737,944 A 4/1998 Nishimura et al.
5,768,730 A 6/1998 Matsumoto et al. ..... 8/159
5,842,358 A 12/1998 Koo et al.
5,862,686 A 1/1999 Skrippek
5,870,905 A 2/1999 Imamura et al. ..... 68/12.04
5,894,746 A 4/1999 Skrippek
5,907,880 A 6/1999 Durazzani et al.
5,913,951 A 6/1999 Herr et al. ..... 81/158
5,924,312 A 7/1999 Vande Haar
5,927,106 A 7/1999 Pellerin
5,947,136 A 9/1999 Abras
5,961,105 A 10/1999 Ehrnsberger et al. ..... 267/216
5,979,195 A 11/1999 Bestell et al. ..... 68/23.2
6,006,553 A 12/1999 Lee et al.
6,032,494 A 3/2000 Tanigawa et al. ..... 68/12.06
6,122,843 A 9/2000 Noguchi et al. ..... 34/596
6,148,647 A 11/2000 Kabeya et al. ..... 68/140

(56) References Cited

U.S. PATENT DOCUMENTS

| | | | | |
|---|---|---|---|---|
| 6,343,492 | B1 | 2/2002 | Seagar et al. | 68/142 |
| 6,363,756 | B1 | 4/2002 | Seagar et al. | 68/210 |
| 6,460,382 | B1 | 10/2002 | Kim et al. | 68/140 |
| 6,474,114 | B1 | 11/2002 | Ito et al. | 68/140 |
| 6,477,867 | B1 | 11/2002 | Collecutt et al. | 68/12.06 |
| 6,481,035 | B2 | 11/2002 | Seagar et al. | 81/159 |
| 6,510,715 | B1 | 1/2003 | Simsek | 68/12.06 |
| 6,510,716 | B1 | 1/2003 | Kim et al. | 68/24 |
| 6,516,638 | B1 | 2/2003 | Myerscough | 68/23.1 |
| 6,539,753 | B1 | 4/2003 | Ito et al. | 68/3 |
| 6,557,383 | B1 | 5/2003 | Ito et al. | 68/23.2 |
| 6,564,594 | B1 * | 5/2003 | Ito et al. | 68/24 |
| 6,578,225 | B2 | 6/2003 | Jönsson | 8/159 |
| 6,578,391 | B2 | 6/2003 | Seagar et al. | 68/142 |
| 6,612,138 | B2 | 9/2003 | Ryu et al. | |
| 6,626,014 | B2 | 9/2003 | Heyder et al. | 68/140 |
| 6,662,682 | B2 | 12/2003 | Stalsberg | |
| 6,681,602 | B2 | 1/2004 | Heyder et al. | |
| 6,782,722 | B2 | 8/2004 | Yokoi et al. | |
| 6,968,632 | B2 | 11/2005 | Guinibert et al. | |
| 6,981,395 | B2 | 1/2006 | Ryu et al. | 68/17 |
| 7,013,682 | B2 | 3/2006 | Sharrow | |
| 7,065,905 | B2 | 6/2006 | Guinibert et al. | |
| 7,073,356 | B2 | 7/2006 | Nakamura et al. | 68/12.26 |
| 7,117,613 | B2 | 10/2006 | Guinibert et al. | |
| 7,225,562 | B2 | 6/2007 | Guinibert et al. | |
| 7,249,742 | B2 | 7/2007 | Guinibert et al. | |
| 7,257,905 | B2 | 8/2007 | Guinibert et al. | |
| 7,334,799 | B2 | 2/2008 | O'Hara | 277/361 |
| 7,412,783 | B2 | 8/2008 | Guinibert et al. | |
| 7,467,483 | B2 | 12/2008 | Guinibert et al. | |
| 7,520,148 | B2 | 4/2009 | Choi | |
| 7,536,882 | B2 | 5/2009 | Kim et al. | |
| 7,574,879 | B2 | 8/2009 | Chang et al. | |
| 7,607,326 | B2 | 10/2009 | Chang et al. | |
| 7,762,007 | B2 | 7/2010 | Guinibert et al. | |
| 7,797,971 | B2 | 9/2010 | Kawabata et al. | |
| 7,841,220 | B2 | 11/2010 | Lim et al. | |
| 2002/0000108 | A1 | 1/2002 | Heyder et al. | |
| 2002/0014095 | A1 | 2/2002 | Seagar et al. | |
| 2002/0042957 | A1 | 4/2002 | Kim et al. | |
| 2002/0166349 | A1 | 11/2002 | Lim et al. | 68/23.7 |
| 2002/0194884 | A1 | 12/2002 | Heyder et al. | |
| 2003/0056302 | A1 | 3/2003 | Broker et al. | 8/159 |
| 2003/0061841 | A1 | 4/2003 | Nakamura et al. | |
| 2004/0025544 | A1 | 2/2004 | Kim et al. | 68/3 |
| 2004/0031295 | A1 | 2/2004 | Choi | 68/24 |
| 2004/0035155 | A1 | 2/2004 | Yoon | 68/145 |
| 2004/0123631 | A1 | 7/2004 | Chang | 68/23.1 |
| 2004/0129035 | A1 | 7/2004 | Chang | 68/23 |
| 2004/0148981 | A1 | 8/2004 | Kim et al. | |
| 2004/0163425 | A1 | 8/2004 | Kim et al. | |
| 2004/0163428 | A1 | 8/2004 | Kim et al. | 68/140 |
| 2004/0237603 | A1 | 12/2004 | Kim et al. | 68/15 |
| 2004/0244121 | A1 | 12/2004 | Lim et al. | 8/159 |
| 2004/0244168 | A1 | 12/2004 | Lee | 29/283.5 |
| 2004/0244438 | A1 | 12/2004 | North | |
| 2005/0028564 | A1 | 2/2005 | Lee et al. | 68/24 |
| 2005/0188472 | A1 | 9/2005 | Park et al. | 8/158 |
| 2005/0274159 | A1 | 12/2005 | Jeon et al. | |
| 2006/0010612 | A1 | 1/2006 | Kim et al. | 8/158 |
| 2006/0011429 | A1 | 1/2006 | Park et al. | 188/322.13 |
| 2006/0016228 | A1 | 1/2006 | Chang et al. | 68/23.1 |
| 2006/0254321 | A1 | 11/2006 | Lim et al. | |
| 2007/0125135 | A1 | 6/2007 | Kim et al. | 69/140 |
| 2007/0227200 | A1 | 10/2007 | Kim et al. | 68/140 |

FOREIGN PATENT DOCUMENTS

| | | | |
|---|---|---|---|
| CN | 1332816 | A | 1/2002 |
| CN | 1414163 | A | 4/2003 |
| CN | 1511997 | A | 7/2004 |
| CN | 1515732 | A | 7/2004 |
| CN | 1550609 | A | 12/2004 |
| CN | 1614123 | | 5/2005 |
| DE | 1 095 778 | | 12/1960 |
| DE | 1 113 439 | | 9/1961 |
| DE | 1 188 547 | | 3/1965 |
| DE | 19 12 481 | U | 3/1965 |
| DE | 24 01 888 | A1 | 7/1975 |
| DE | 24 54 489 | A1 | 5/1976 |
| DE | 26 06 589 | | 9/1976 |
| DE | 26 33 604 | A1 | 2/1978 |
| DE | 27 32 684 | A1 | 2/1978 |
| DE | 27 46 989 | A1 | 4/1978 |
| DE | 26 49 341 | | 5/1978 |
| DE | 31 09 641 | A1 | 2/1982 |
| DE | 31 34 633 | A1 | 8/1982 |
| DE | 34 37 835 | A1 | 5/1985 |
| DE | 37 13 921 | | 11/1988 |
| DE | 38 11 583 | A1 | 10/1989 |
| DE | 39 07 258 | A1 | 10/1989 |
| DE | 39 34 434 | A1 | 4/1991 |
| DE | 42 39 504 | A1 | 5/1994 |
| DE | 43 10 594 | A1 | 10/1994 |
| DE | 4 426 900 | | 2/1995 |
| DE | 43 30 079 | A1 | 3/1995 |
| DE | 37 13 021 | * | 11/1998 |
| DE | 198 06 884 | | 8/1999 |
| DE | 199 61 780 | | 7/2001 |
| EP | 0 124 939 | B1 | 11/1984 |
| EP | 0 132 805 | A1 | 2/1985 |
| EP | 0 272 949 | B1 | 6/1988 |
| EP | 0 371 926 | A1 | 6/1990 |
| EP | 0 405 068 | B1 | 1/1991 |
| EP | 0 465 885 | | 1/1992 |
| EP | 0 716 177 | B1 | 6/1996 |
| EP | 0 750 064 | A1 | 12/1996 |
| EP | 0 869 212 | | 10/1998 |
| EP | 0 943 720 | | 9/1999 |
| EP | 0 969 134 | A1 | 1/2000 |
| EP | 0 725 179 | B1 | 7/2000 |
| EP | 1 055 765 | A1 | 11/2000 |
| EP | 1 079 014 | B1 | 2/2001 |
| EP | 1 094 239 | B1 | 4/2001 |
| EP | 1 201 810 | | 5/2002 |
| EP | 1 386 996 | B1 | 2/2004 |
| EP | 1 433 890 | B1 | 6/2004 |
| EP | 1 433 891 | A2 | 6/2004 |
| EP | 1 455 011 | | 9/2004 |
| EP | 1 505 191 | A1 | 2/2005 |
| EP | 1 548 170 | | 6/2005 |
| EP | 1 605 088 | A2 | 12/2005 |
| EP | 1 619 286 | | 1/2006 |
| EP | 1 688 531 | A1 | 8/2006 |
| FR | 2 116 896 | | 7/1972 |
| FR | 2 230 782 | | 1/1975 |
| FR | 2 478 151 | | 9/1981 |
| FR | 2 511 401 | | 2/1983 |
| FR | 2 610 017 | | 7/1988 |
| GB | 646582 | | 11/1950 |
| GB | 1120431 | | 7/1968 |
| GB | 1 181 797 | | 2/1970 |
| GB | 1 270 950 | | 4/1972 |
| GB | 1 353 283 | | 5/1974 |
| GB | 2 096 649 | A | 10/1982 |
| GB | 2 157 326 | A | 10/1985 |
| GB | 2 189 511 | | 10/1987 |
| GB | 2 202 867 | * | 10/1988 |
| GB | 2 202 867 | A | 10/1988 |
| GB | 2 360 296 | | 9/2001 |
| JP | 39-21844 | U | 7/1962 |
| JP | 48-64179 | | 8/1973 |
| JP | 49-135264 | | 11/1974 |
| JP | 52-134264 | | 11/1977 |
| JP | 54-028470 | | 3/1979 |
| JP | 56-116987 | A | 9/1981 |
| JP | 57-43792 | A | 3/1982 |
| JP | 59-211496 | A | 11/1984 |
| JP | 60-190998 | | 9/1985 |
| JP | 63-95587 | U | 6/1988 |
| JP | 01-230390 | | 9/1989 |
| JP | 02-189188 | | 7/1990 |

(56) References Cited

FOREIGN PATENT DOCUMENTS

| | | | | |
|---|---|---|---|---|
| JP | 03-141988 | | * | 6/1991 |
| JP | 03-88479 | U | | 9/1991 |
| JP | 04-092697 | A | | 3/1992 |
| JP | 04-210091 | | | 7/1992 |
| JP | 4-220291 | | | 8/1992 |
| JP | 04-236988 | A | | 8/1992 |
| JP | 04-240488 | A | | 8/1992 |
| JP | 04-325196 | | | 11/1992 |
| JP | 04-371194 | A | | 12/1992 |
| JP | 05-084388 | A | | 4/1993 |
| JP | 5-084389 | | | 4/1993 |
| JP | 05-220293 | A | | 8/1993 |
| JP | 06-079087 | A | | 3/1994 |
| JP | 09-066185 | | | 3/1997 |
| JP | 09-182368 | | | 7/1997 |
| JP | 09-182370 | A | | 7/1997 |
| JP | 9-313780 | | | 12/1997 |
| JP | 10-201993 | A | | 8/1998 |
| JP | 10-263265 | | | 10/1998 |
| JP | 11-076680 | A | | 3/1999 |
| JP | 2000-262796 | A | | 9/2000 |
| JP | 2000-334194 | A | | 12/2000 |
| JP | 2002-153695 | A | | 5/2002 |
| JP | 2002-529173 | T | | 9/2002 |
| JP | 2002-346281 | | * | 12/2002 |
| JP | 2002-346281 | A | | 12/2002 |
| JP | 2003-079995 | | | 3/2003 |
| JP | 2003-230792 | A | | 8/2003 |
| JP | 2004-513721 | | | 5/2004 |
| JP | 2004-188204 | | | 7/2004 |
| JP | 2004-209255 | | | 7/2004 |
| JP | 2005-198698 | | | 7/2005 |
| JP | 2006-026408 | | | 2/2006 |
| JP | 2006-034755 | | | 2/2006 |
| KR | 10-1999-0066050 | A | | 8/1999 |
| KR | 10-1999-0079731 | A | | 11/1999 |
| KR | 10-2001-0009545 | A | | 2/2001 |
| KR | 2001-0046776 | | | 6/2001 |
| KR | 10-2004-0011307 | A | | 2/2004 |
| KR | 10-2004-0026887 | | | 4/2004 |
| KR | 10-2004-0047223 | A | | 6/2004 |
| KR | 10-2004-0058999 | | | 7/2004 |
| KR | 10-2004-0058999 | A | | 7/2004 |
| KR | 10-2006-0009075 | | | 1/2006 |
| KR | 10-2006-00028804 | | | 4/2006 |
| SU | 1181112 | A | | 9/1986 |
| SU | 1615258 | | | 12/1990 |
| SU | 1663074 | A1 | | 7/1991 |
| SU | 1 703 740 | | | 1/1992 |
| WO | WO 98/29595 | A2 | | 7/1998 |
| WO | WO 99/35320 | | | 7/1999 |
| WO | WO 03/097918 | | | 11/2003 |
| WO | WO 2005/071155 | | | 8/2005 |

OTHER PUBLICATIONS

European Patent Office 0 405 068 Jan. 1991.*
U.S. Office Action dated Dec. 30, 2005 issued in U.S. Appl. No. 10/461,451.
U.S. Final Office Action dated Aug. 14, 2006 issued in U.S. Appl. No. 10/461,451.
U.S. Final Office Action dated Dec. 13, 2006 issued in U.S. Appl. No. 10/461,451.
U.S. Office Action dated Jan. 5, 2007 issued in U.S. Appl. No. 11/475,885.
U.S. Office Action dated Apr. 27, 2007 issued in U.S. Appl. No. 10/461,451.
U.S. Office Action dated Jun. 8, 2007 issued in U.S. Appl. No. 11/470,704.
U.S. Office Action dated Nov. 30, 2007 issued in U.S. Appl. No. 11/470,704.
U.S. Final Office Action dated Jul. 17, 2007 issued in U.S. Appl. No. 11/475,885.
U.S. Office Action dated Nov. 19, 2007 issued in U.S. Appl. No. 10/461,451.
U.S. Office Action dated Apr. 1, 2008 issued in U.S. Appl. No. 11/475,885.
U.S. Final Office Action dated May 15, 2008 issued in U.S. Appl. No. 11/470,704.
U.S. Final Office Action dated Jun. 16, 2008 issued in U.S. Appl. No. 10/461,451.
U.S. Office Action dated Sep. 5, 2008 issued in U.S. Appl. No. 11/165,332.
U.S. Office Action dated Sep. 11, 2008 issued in U.S. Appl. No. 11/470,704.
U.S. Final Office Action dated Feb. 25, 2009 issued in U.S. Appl. No. 11/165,332.
U.S. Office Action dated Feb. 25, 2009 issued in U.S. Appl. No. 12/198,269.
Japanese Office Action dated Mar. 2, 2009 issued in Application No. 2004-000478.
Japanese Office Action dated Dec. 18, 2009 issued in Application No. 2004-000478.
U.S. Office Action dated Sep. 21, 2009 issued in U.S. Appl. No. 12/267,457.
U.S. Final Office Action dated Oct. 14, 2009 issued in U.S. Appl. No. 12/198,269.
U.S. Office Action dated Oct. 15, 2009 issued in U.S. Appl. No. 11/529,759.
U.S. Office Action dated Oct. 28, 2009 issued in U.S. Appl. No. 12/230,031.
U.S. Office Action dated Feb. 2, 2010 issued in U.S. Appl. No. 12/198,269.
European Search Report dated Feb. 3, 2010 issued in Application No. 09178918.0.
U.S. Final Office Action dated Mar. 5, 2010 issued in U.S. Appl. No. 12/267,457.
Chinese Office Action dated Mar. 8, 2010 issued in Application No. 200610142200.6.
U.S. Final Office Action dated Mar. 19, 2010 issued in U.S. Appl. No. 11/529,759.
Notice of Opposition dated May 7, 2010 filed in the European Patent Office for European Patent Application No. 05013603.5 (Publication No. EP 1 619 286 B1).
U.S. Final Office Action dated May 14, 2010 issued in U.S. Appl. No. 12/230,031.
U.S. Office Action dated Aug. 13, 2010 issued in U.S. Appl. No. 12/639,872.
Notice of Opposition and Opposition Brief filed in EP Application No. 03013411.8 dated Sep. 29, 2010 (Publication No. EP 1 433 890 B1) (full German text and English translation).
U.S. Office Action issued in U.S. Appl. No. 12/797,758 dated Oct. 28, 2010.
U.S. Office Action issued in U.S. Appl. No. 12/639,859 dated Dec. 9, 2010.
U.S. Office Action issued in U.S. Appl. No. 12/940,138 dated Dec. 16, 2010.
U.S. Office Action issued in U.S. Appl. No. 12/639,894 dated Dec. 23, 2010.
Chinese Office Action issued in CN Application No. 200710089087.4 dated Jan. 8, 2010.
European Search Report issued in EP Application No. 10012467 dated Nov. 25, 2010.
Final U.S. Office Action issued in U.S. Appl. No. 12/797,758 dated Mar. 17, 2011.
European Search Report issued in EP Application No. 10012465 dated Mar. 24, 2011.
European Search Report issued in EP Application No. 10012469 dated Apr. 8, 2011.
European Search Report issued in EP Application No. 10012470 dated Apr. 8, 2011.
U.S. Office Action issued in U.S. Appl. No. 12/940,096 dated Apr. 18, 2011.
Final U.S. Office Action issued in U.S. Appl. No. 12/639,859 dated Apr. 27, 2011.

(56) References Cited

OTHER PUBLICATIONS

European Search Report issued in EP Application No. 10012468 dated May 4, 2011.
Final U.S. Office Action issued in U.S. Appl. No. 12/940,138 dated May 20, 2011.
Japanese Office Action issued in JP Application No. 2005-204374 dated Jul. 28, 2010.
Japanese Office Action issued in JP Application No. 2006-235745 dated Aug. 3, 2010.
European Office Action issued in EP Application No. 10 012 465.0-2314 dated Dec. 7, 2011.
Office Action issued in U.S. Appl. No. 13/241,366 dated Jan. 31, 2012.
Notice of Allowance issued in U.S. Appl. No. 13/239,439 dated Feb. 9, 2012.
Notice of Allowance issued in U.S. Appl. No. 13/239,448 dated Feb. 10, 2012.
Office Action issued in U.S. Appl. No. 13/241,366 dated Feb. 10, 2012.
Office Action issued in U.S. Appl. No. 13/241,348 dated Feb. 23, 2012.
Office Action issued in U.S. Appl. No. 13/239,424 dated Feb. 29, 2012.
Office Action issued in U.S. Appl. No. 13/241,411 dated Mar. 6, 2012.
Office Action issued in U.S. Appl. No. 13/239,427 dated Mar. 21, 2012.
Office Action issued in U.S. Appl. No. 13/241,337 dated Mar. 22, 2012.
Office Action issued in U.S. Appl. No. 13/239,416 dated Apr. 12, 2012.
Office Action issued in U.S. Appl. No. 13/116,089 dated Apr. 13, 2012.
Office Action issued in U.S. Appl. No. 13/116,077 dated Apr. 16, 2012.
Office Action issued in U.S. Appl. No. 13/116,096 dated Apr. 16, 2012.
Office Action issued in U.S. Appl. No. 13/116,114 dated Apr. 18, 2012.
Office Action issued in U.S. Appl. No. 13/116,159 dated Apr. 18, 2012.
Office Action issued in U.S. Appl. No. 13/239,430 dated May 4, 2012.
Office Action issued in U.S. Appl. No. 13/239,422 dated May 9, 2012.
Final Office Action issued in U.S. Appl. No. 13/241,348 dated Jun. 25, 2012.
Final Office Action issued in U.S. Appl. No. 13/241,366 dated Jun. 26, 2012.
Final Office Action issued in U.S. Appl. No. 13/241,396 dated Jun. 27, 2012.
Supplemental Notice of Allowability issued in U.S. Appl. No. 13/239,424 dated Jul. 10, 2012.
Non-Final Office Action issued in U.S. Appl. No. 13/239,410 dated Jul. 19, 2012.
Final Office Action issued in U.S. Appl. No. 13/241,337 dated Sep. 18, 2012.
Summons to Attend Oral Proceedings issued in EP Application No. 03013411.8 dated Jul. 14, 2011.
Office Action issued in U.S. Appl. No. 13/116,059 dated Nov. 28, 2011.
Office Action issued in U.S. Appl. No. 13/116,096 dated Nov. 29, 2011.
Office Action issued in U.S. Appl. No. 13/116,114 dated Nov. 29, 2011.
Office Action issued in U.S. Appl. No. 13/116,077 dated Nov. 30, 2011.
Office Action issued in U.S. Appl. No. 13/116,089 dated Nov. 30, 2011.
Office Action issued in U.S. Appl. No. 13/116,159 dated Nov. 30, 2011.
Office Action issued in U.S. Appl. No. 13/116,147 dated Nov. 30, 2011.
Office Action issued in U.S. Appl. No. 13/116,105 dated Dec. 1, 2011.
European Search Report issued in EP Application No. 10012611.9 dated Dec. 20, 2012.
U.S. Final Office Action issued in U.S. Appl. No. 12/639,894 dated Aug. 3, 2011.
U.S. Final Office Action issued in U.S. Appl. No. 12/940,096 dated Sep. 8, 2011.
Office Action issued in U.S. Appl. No. 13/116,096 dated Sep. 21, 2012.
Final Office Action issued in U.S. Appl. No. 13/116,096 dated Feb. 20, 2013.
Non Final Office Action issued in U.S. Appl. No. 13/239,523 dated Feb. 21, 2013.
Non Final Office Action issued in U.S. Appl. No. 12/639,859 dated Mar. 11, 2013.
U.S. Office Action issued in U.S. Appl. No. 13/239,547 dated Apr. 18, 2013.
U.S. Office Action issued in U.S. Appl. No. 12/267,457 dated Apr. 22, 2013.
U.S. Office Action issued in U.S. Appl. No. 12/940,138 dated Apr. 30, 2013.
U.S. Office Action issued in U.S. Appl. No. 13/241,396 dated May 15, 2013.
U.S. Office Action issued in U.S. Appl. No. 13/241,348 dated May 28, 2013.
U.S. Office Action issued in U.S. Appl. No. 13/239,576 dated Jun. 5, 2013.
U.S. Office Action issued in U.S. Appl. No. 13/239,407 dated Jun. 10, 2013.
U.S. Office Action issued in U.S. Appl. No. 13/239,603 dated Jun. 12, 2013.
U.S. Office Action issued in U.S. Appl. No. 12/639,859 dated Jun. 14, 2013.
U.S. Office Action issued in U.S. Appl. No. 13/239,413 dated Jun. 26, 2013.
U.S. Office Action issued in U.S. Appl. No. 13/239,476 dated Jun. 28, 2013.
U.S. Office Action issued in U.S. Appl. No. 13/239,565 dated Jul. 10, 2013.
U.S. Office Action issued in U.S. Appl. No. 13/239,481 dated Aug. 9, 2013.
U.S. Office Action issued in U.S. Appl. No. 13/239,590 dated Aug. 20, 2013.
U.S. Office Action issued in U.S. Appl. No. 13/239,547 dated Sep. 4, 2013.
U.S. Office Action issued in U.S. Appl. No. 13/940,096 dated Sep. 5, 2013.
U.S. Office Action issued in U.S. Appl. No. 13/239,513 dated Sep. 6, 2013.
U.S. Office Action issued in U.S. Appl. No. 13/239,538 dated Sep. 18, 2013.
U.S. Final Office Action issued in U.S. Appl. No. 13/239,603 dated Sep. 27, 2013.
U.S. Notice of Allowance issued in U.S. Appl. No. 12/940,138 dated Oct. 2, 2013.
U.S. Notice of Allowance issued in U.S. Appl. No. 13/239,523 dated Oct. 15, 2013.
U.S. Notice of Allowance issued in U.S. Appl. No. 13/116,096 dated Oct. 22, 2013.
U.S. Office Action issued in U.S. Appl. No. 13/239,492 dated Oct. 23, 2013.
U.S. Office Action issued in U.S. Appl. No. 13/239,547 dated Nov. 22, 2013.
U.S. Final Office Action issued in U.S. Appl. No. 13/239,407 dated Nov. 22, 2013.

* cited by examiner

DRUM TYPE WASHING MACHINE

The present application is a 37 C.F.R. §1.53(b) continuation of U.S. patent application Ser. No. 12/639,872 filed on Dec. 16, 2009, now U.S. Pat. No. 7,930,910 which is a 37 C.F.R. §1.53(b) continuation of U.S. patent application Ser. No. 12/267,457 filed Nov. 7, 2008, currently pending, which is a 37 C.F.R. §1.53(b) continuation of U.S. patent application Ser. No. 10/461,451 filed Jun. 16, 2003, now U.S. Pat. No. 7,533,548 B2, which claims priority to Korean Patent Application No. 85521/2002, filed Dec. 27, 2002, the entire contents of which are hereby incorporated by reference herein.

BACKGROUND OF THE INVENTION

1. Field of the Invention

The present invention relates to a drum type washing machine, and more particularly, to a drum type washing machine which can maximize a capacity of a drum without changing an entire size of a washing machine.

2. Description of the Related Art

FIG. 1 is a side sectional view showing a drum type washing machine in accordance with the conventional art, FIG. 2 is a front sectional view showing the drum type washing machine in accordance with the conventional art.

The conventional drum type washing machine comprises: a cabinet 102 for forming an appearance; a tub 104 arranged in the cabinet 102 for storing washing water; a drum 106 rotatably arranged in the tub 104 for washing and dehydrating laundry; and a driving motor 110 positioned at a rear side of the tub 104 and connected to the drum 106 by a driving shaft 108 thus for rotating the drum 106.

An inlet 112 for inputting or outputting the laundry is formed at the front side of the cabinet 102, and a door 114 for opening and closing the inlet 112 is formed at the front side of the inlet 112.

The tub 104 of a cylindrical shape is provided with an opening 116 at the front side thereof thus to be connected to the inlet 112 of the cabinet 102, and a balance weight 118 for maintaining a balance of the tub 104 and reducing vibration are respectively formed at both sides of the tub 104.

Herein, a diameter of the tub 104 is installed to be less than a width of the cabinet 102 by approximately 30-40 mm with consideration of a maximum vibration amount thereof so as to prevent from being contacted to the cabinet 102 at the time of the dehydration.

The drum 106 is a cylindrical shape of which one side is opened so that the laundry can be inputted, and has a diameter installed to be less than that of the tub 104 by approximately 15-20 mm in order to prevent interference with the tub 104 since the drum is rotated in the tub 104.

A plurality of supporting springs 120 are installed between the upper portion of the tub 104 and the upper inner wall of the cabinet 102, and a plurality of dampers 122 are installed between the lower portion of the tub 104 and the lower inner wall of the cabinet 102, thereby supporting the tub 104 with buffering.

A gasket 124 is formed between the inlet 112 of the cabinet 102 and the opening 116 of the tub 104 so as to prevent washing water stored in the tub 104 from being leaked to a space between the tub 104 and the cabinet 102. Also, a supporting plate 126 for mounting the driving motor 110 is installed at the rear side of the tub 104.

The driving motor 110 is fixed to a rear surface of the supporting plate 126, and the driving shaft 108 of the driving motor 110 is fixed to a lower surface of the drum 106, thereby generating a driving force by which the drum 106 is rotated.

In the conventional drum type washing machine, the diameter of the tub 104 is installed to be less than the width of the cabinet 102 with consideration of the maximum vibration amount so as to prevent from being contacted to the cabinet 102, and the diameter of drum 106 is also installed to be less than that of the tub 104 in order to prevent interference with the tub 104 since the drum is rotated in the tub 104. According to this, so as to increase the diameter of the drum 106 which determines a washing capacity, a size of the cabinet 102 has to be increased.

Also, since the gasket 124 for preventing washing water from being leaked is installed between the inlet 112 of the cabinet 102 and the opening 116 of the tub 104, a length of the drum 106 is decreased as the installed length of the gasket 124. According to this, it was difficult to increase the capacity of the drum 106.

SUMMARY OF THE INVENTION

Therefore, an object of the present invention is to provide a drum type washing machine which can increase a washing capacity without changing an entire size thereof, in which a cabinet and a tub is formed integrally and thus a diameter of a drum can be increased without increasing a size of the cabinet.

Another object of the present invention is to provide a drum type washing machine which can increase a washing capacity by increasing a length of a drum without increasing a length of a cabinet, in which the cabinet and a tub are formed integrally and thus a location of a gasket is changed.

To achieve these and other advantages and in accordance with the purpose of the present invention, as embodied and broadly described herein, there is provided a drum type washing machine comprising: a cabinet for forming an appearance; a tub fixed to an inner side of the cabinet and for storing washing water; a drum rotatably arranged in the tub for washing and dehydrating laundry; and a driving motor positioned at the rear side of the drum for generating a driving force by which the drum is rotated.

The tub is a cylindrical shape, and a front surface thereof is fixed to a front inner wall of the cabinet.

Both sides of the tub are fixed to both sides inner wall of the cabinet.

A supporting plate for mounting the driving motor is located at the rear side of the tub, and a gasket hermetically connects the supporting plate and the rear side of the tub, in which the gasket is formed as a bellows and has one side fixed to the rear side of the tub and another side fixed to an outer circumference surface of the supporting plate.

A supporting unit for supporting an assembly composed of the drum, the driving motor, and the supporting plate with buffering is installed between the supporting plate and the cabinet.

The supporting unit comprises: a plurality of upper supporting rods connected to an upper side of the supporting plate towards an orthogonal direction and having a predetermined length; buffering springs connected between the upper supporting rods and an upper inner wall of the cabinet for buffering; a plurality of lower supporting rods connected to a lower side of the supporting plate towards an orthogonal direction and having a predetermined length; and dampers connected between the lower supporting rods and a lower inner wall of the cabinet for absorbing vibration.

The drum is provided with a liquid balancer at a circumference of an inlet thereof for maintaining a balance when the drum is rotated.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
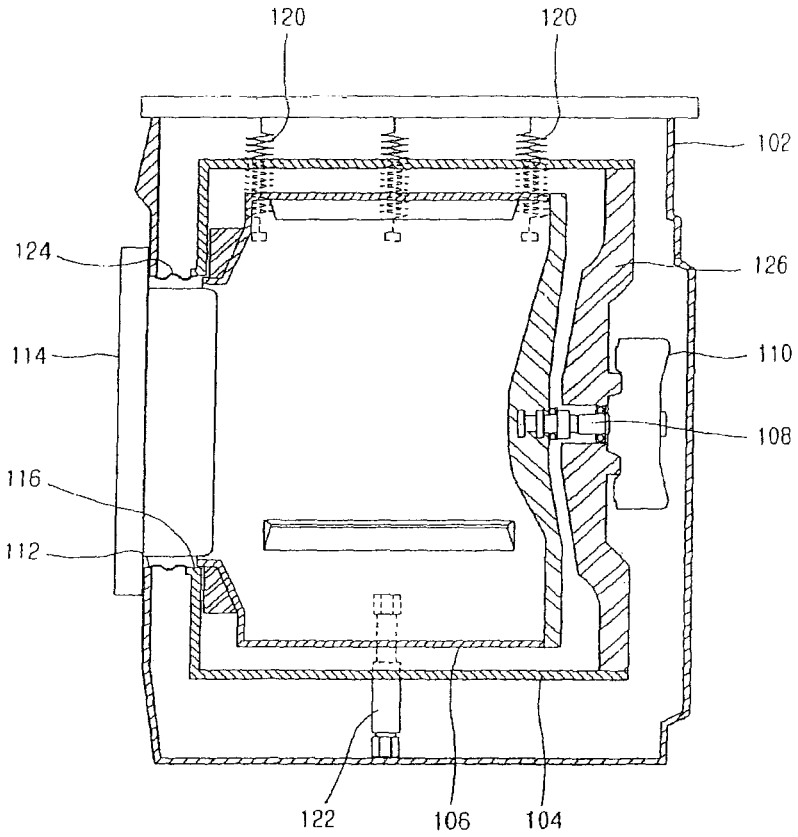
FIG. 1 CONVENTIONAL ART
FIG. 1 is a side sectional view showing a drum type washing machine in accordance with the conventional art.
Figure 2:
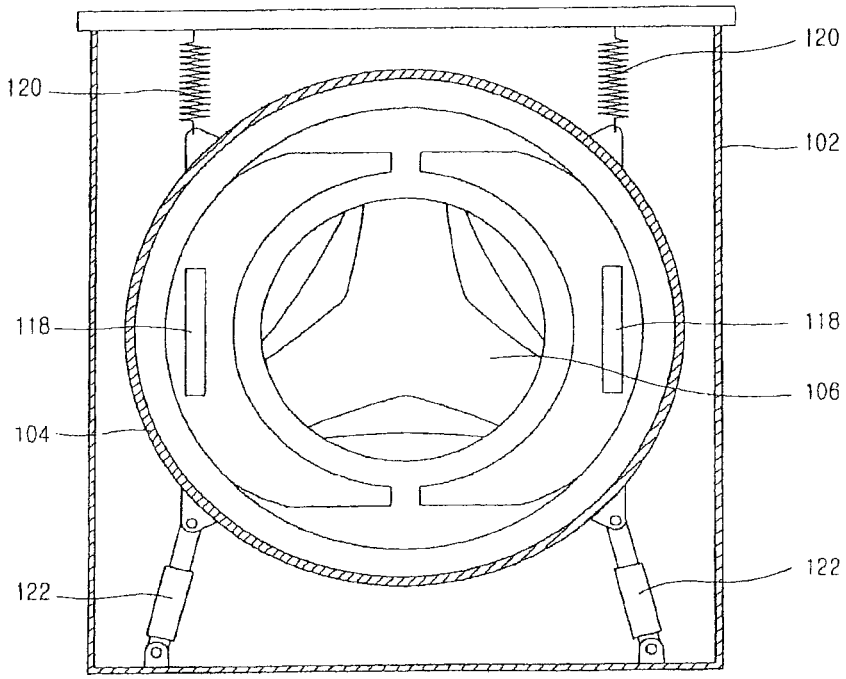
FIG. 2 CONVENTIONAL ART
FIG. 2 is a front sectional view showing the drum type washing machine in accordance with the conventional art.
Figure 3:
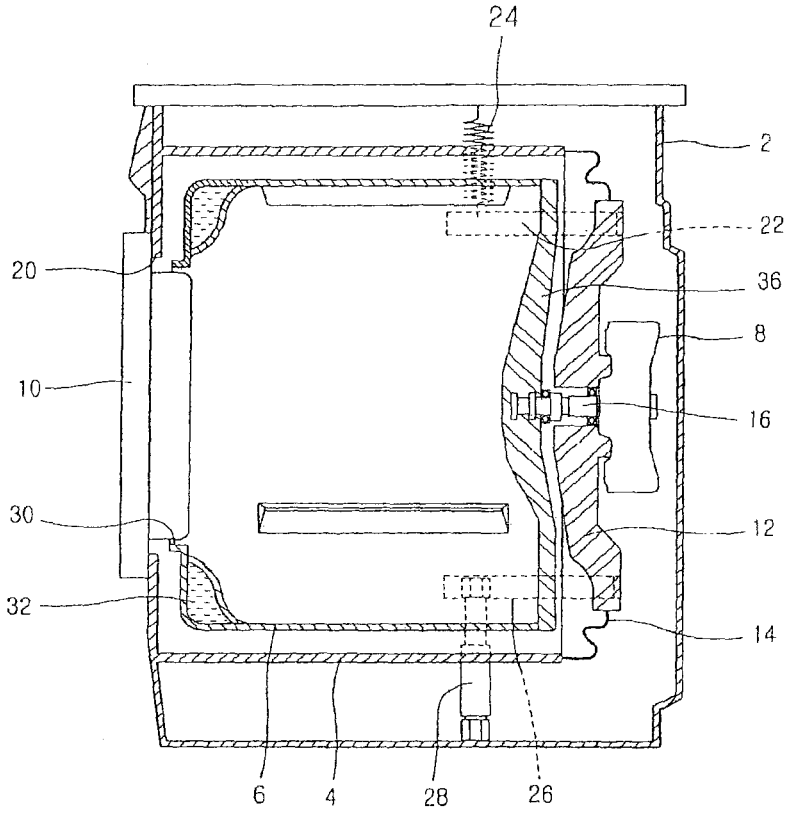
FIG. 3 is a side sectional view showing a drum type washing machine according to one embodiment of the present invention.
Figure 4:
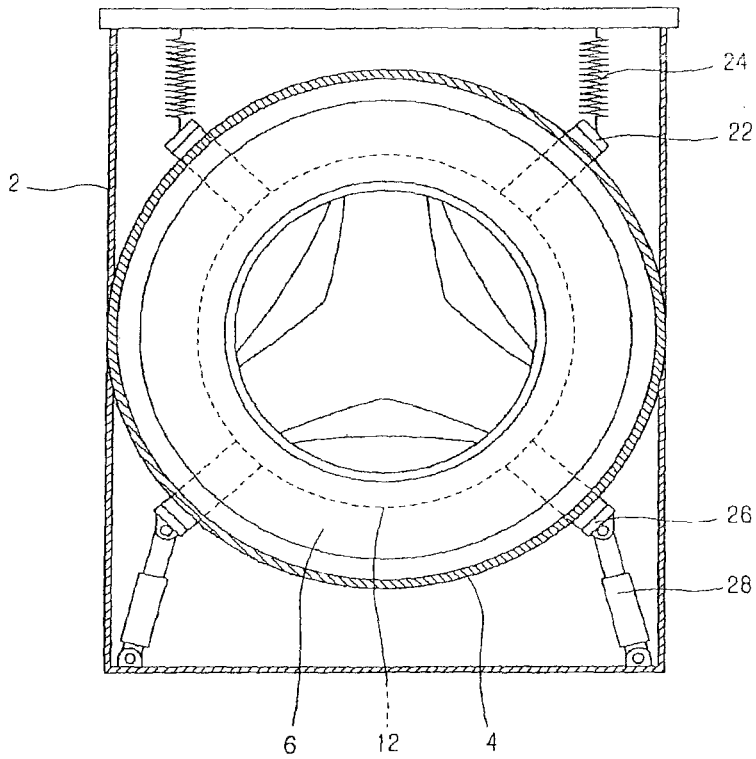
FIG. 4 is a front sectional view showing the drum type washing machine according to one embodiment of the present invention.
Figure 5:
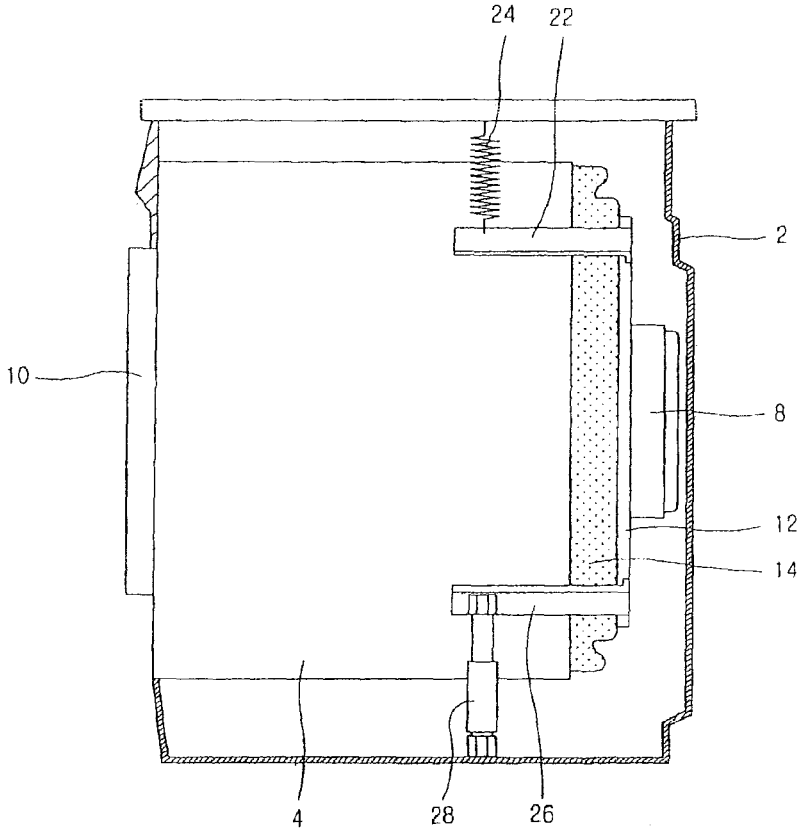
FIG. 5 is a lateral view showing a state that a casing of the drum type washing machine according to one embodiment of the present invention is cut.

FIG. 3 is a side sectional view showing a drum type washing machine according to one embodiment of the present invention, and FIG. 4 is a front sectional view showing the drum type washing machine according to one embodiment of the present invention.

The drum type washing machine according to one embodiment of the present invention comprises: a cabinet 2 for forming an appearance of a washing machine; a tub 4 formed integrally with the cabinet 2 and for storing washing water; a drum 6 rotatably arranged in the tub 4 for washing and dehydrating laundry; and a driving motor 8 positioned at the rear side of the drum 6 for generating a driving force by which the drum 6 is rotated.

The cabinet 2 is rectangular parallelepiped, and an inlet 20 for inputting and outputting laundry is formed at the front side of the cabinet 2 and a door 10 for opening and closing the inlet 20 is formed at the inlet 20.

The tub 4 is formed as a cylinder shape having a predetermined diameter in the cabinet 2, and the front side of the tub 4 is fixed to the front inner wall of the cabinet 2 or integrally formed at the front inner wall of the cabinet 2. Both sides of the tub 4 are contacted to both sides inner wall of the cabinet 2 or integrally formed with both sides inner wall of the cabinet 2 thus to be prolonged.

Herein, since both sides of the tub 4 are contacted to both sides inner wall of the cabinet 2, a diameter of the tub 4 can be increased.

Also, the supporting plate 12 is positioned at the rear side of the tub 4 and the gasket 14 is installed between the supporting plate 12 and the rear side of the tub 4, thereby preventing washing water filled in the tub 4 from being leaked.

The gasket 14 is formed as a bellows of a cylinder shape and has one side fixed to the rear side of the tub 4 and another side fixed to an outer circumference surface of the supporting plate 12.

The supporting plate 12 is formed as a disc shape, the driving motor 8 is fixed to the rear surface thereof, and a rotation shaft 16 for transmitting a rotation force of the driving motor 8 to the drum 6 is rotatably supported by the supporting plate 12. Also, a supporting unit for supporting the drum 6 with buffering is installed between the supporting plate 12 and the inner wall of the cabinet 2.

The supporting unit comprises: a plurality of upper supporting rods 22 connected to an upper side of the supporting plate 12 and having a predetermined length; buffering springs 24 connected between the upper supporting rods 22 and an upper inner wall of the cabinet 2 for buffering; a plurality of lower supporting rods 26 connected to a lower side of the supporting plate 12 and having a predetermined length; and dampers 28 connected between the lower supporting rods 26 and a lower inner wall of the cabinet 2 for absorbing vibration.

Herein, the buffering springs 24 and the dampers 28 are installed at a center of gravity of an assembly composed of the drum 6, the supporting plate 12, and the driving motor 8. That is, the upper and lower supporting rods 22 and 26 are prolonged from the supporting plate 12 to the center of gravity of the assembly, the buffering springs 24 are connected between an end portion of the upper supporting rod 22 and the upper inner wall of the cabinet 2, and the dampers 28 are connected between an end portion of the lower supporting rod 26 and the lower inner wall of the cabinet 2, thereby supporting the drum 6 at the center of gravity.

A diameter of the drum 6 is installed in a range that the drum 6 is not contacted to the tub 4 even when the drum 6 generates maximum vibration in order to prevent interference with the tub 4 at the time of being rotated in the tub 4.

Operations of the drum type washing machine according to the present invention are as follows.

If the laundry is inputted into the drum 6 and a power switch is turned on, washing water is introduced into the tub 6. At this time, the front side of the tub 6 is fixed to the cabinet 2 and the gasket 14 is connected between the rear side of the tub 6 and the supporting plate 12, thereby preventing the washing water introduced into the tub 6 from being leaked outwardly.

If the introduction of the washing water is completed, the driving motor 8 mounted at the rear side of the supporting plate 12 is driven, and the drum 6 connected with the driving motor 8 by the rotation shaft 16 is rotated, thereby performing washing and dehydration operations. At this time, the assembly composed of the drum 6, the driving motor, and the supporting plate 12 is supported by the buffering springs 24 and the dampers 28 mounted between the supporting plate 12 and the inner wall of the cabinet 20.

Figure 6:
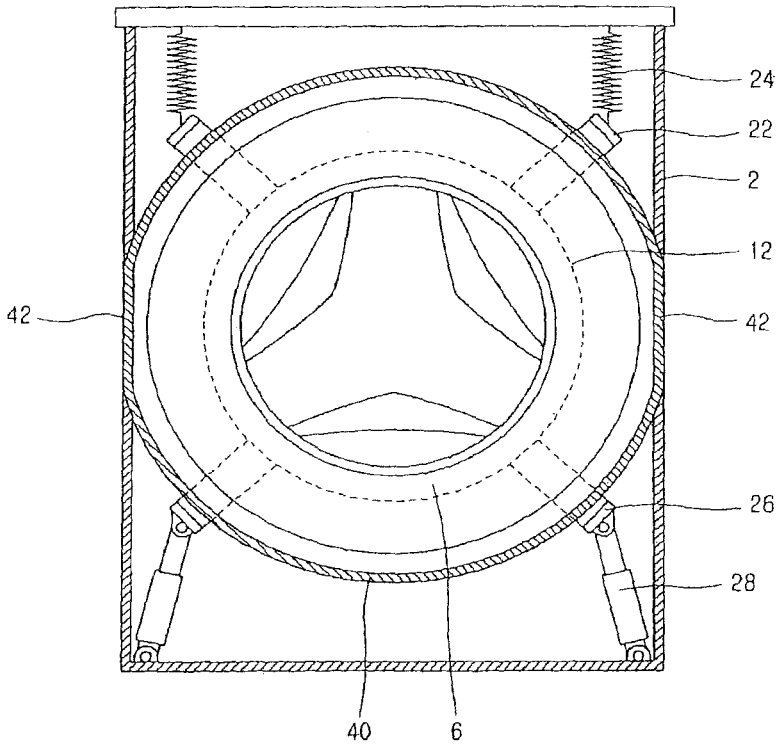
FIG. 6 is a front sectional view of a drum type washing machine according to a second embodiment of the present invention.

FIG. 6 is a front sectional view of a drum type washing machine according to a second embodiment of the present invention.

The drum type washing machine according to the second embodiment of the present invention has the same construction and operation as that of the first to embodiment except a shape of the tub.

That is, the tub 40 according to the second embodiment has a straight line portion 42 with a predetermined length at both sides thereof. The straight line portion 42 is fixed to the inner wall of both sides of the cabinet 2, or integrally formed at the wall surface of both sides of the cabinet 2.

Like this, since the tub 40 according to the second embodiment has both sides fixed to the cabinet 2 as a straight line form, the diameter of the tub 40 can be increased. Accordingly, the diameter of the drum 6 arranged in the tub 40 can be more increased.

Figure 7:
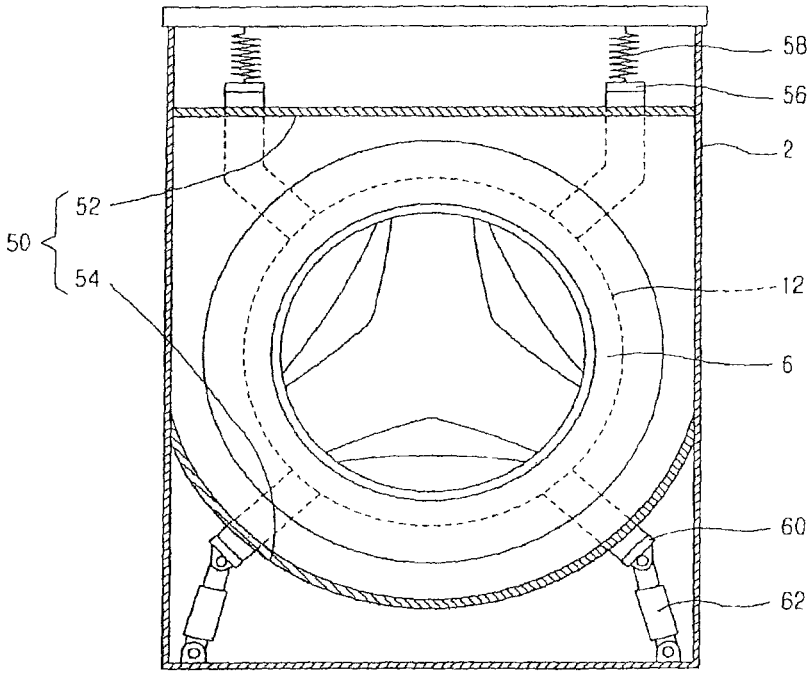
FIG. 7 is a front sectional view showing a drum type washing machine according to a third embodiment of the present invention.
Figure 8:
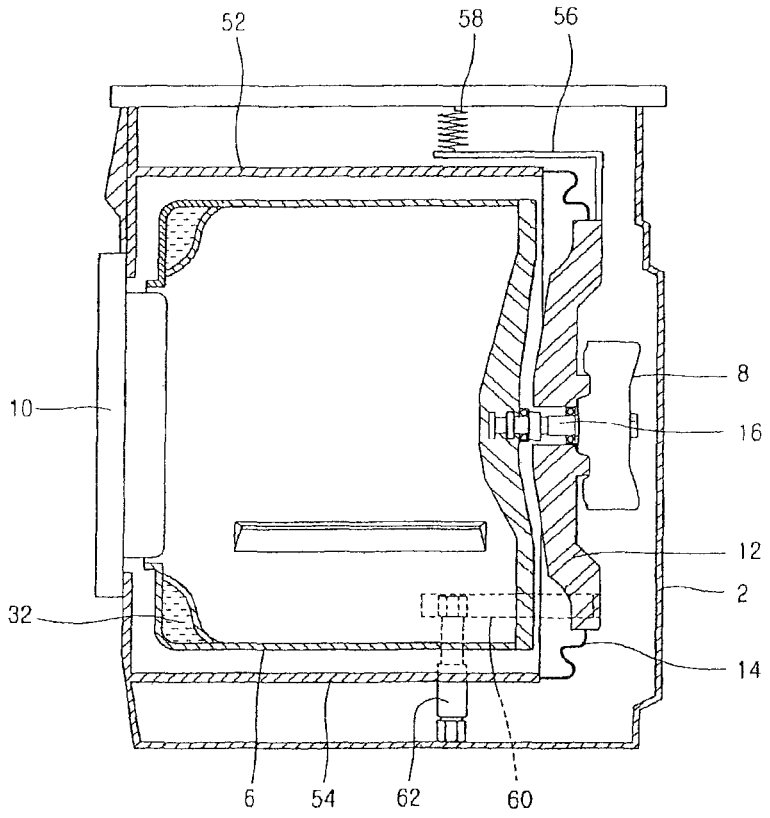
FIG. 8 is a longitudinal sectional view of the drum type washing machine according to the third embodiment of the present invention.
Figure 9:
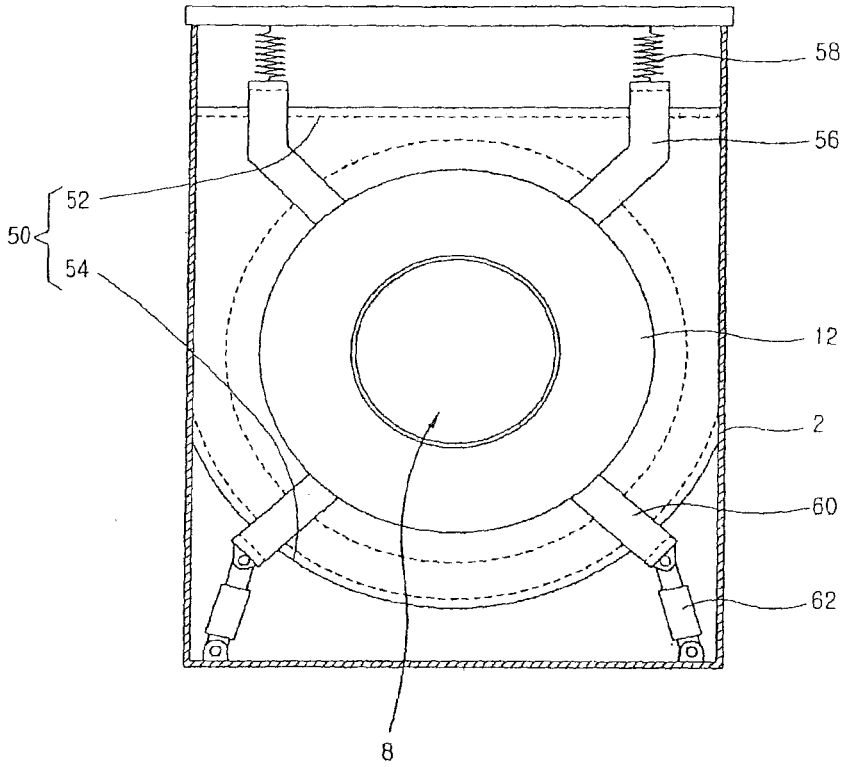
FIG. 9 is a rear sectional view showing the drum type washing machine according to the third embodiment of the present invention.

FIG. 7 is a front sectional view showing a drum type washing machine according to a third embodiment of the present invention, FIG. 8 is a longitudinal sectional view of the drum type washing machine according to the third embodiment of the present invention, and FIG. 9 is a rear sectional view showing the drum type washing machine according to the third embodiment of the present invention.

The drum type washing machine according to the third embodiment of the present invention comprises: a cabinet 2 for forming an appearance of a washing machine; a tub 50 formed integrally with the cabinet 2 and for storing washing water; a drum 6 rotatably arranged in the tub 50 for washing and dehydrating laundry; and a supporting unit positioned at the rear side of the tub 50 and arranged between the supporting plate 12 to which the driving motor 8 is fixed and the cabinet 2 for supporting the drum 6 with buffering.

The tub 50 is composed of a first partition wall 52 fixed to the upper front inner wall and both sides inner wall of the cabinet 2; and a second partition wall 54 integrally fixed to the lower front inner wall and both sides inner wall of the cabinet 2.

The first partition wall 52 of a flat plate shape is formed at the upper side of the cabinet 2 in a state that the front side and both sides are integrally formed at the inner wall of the cabinet 2 or fixed thereto. Also, the second partition wall 54 of a semi-circle shape is formed at the lower side of the cabinet 2 in a state that the front side and both sides are integrally formed at the inner wall of the cabinet 2 or fixed thereto.

The supporting unit comprises: a plurality of upper supporting rods 56 connected to the upper side of the supporting plate 12 and having a predetermined length; buffering springs 58 connected between the upper supporting rods 56 and the upper inner wall of the cabinet 2 for buffering; a plurality of lower supporting rods 60 connected to the lower side of the supporting plate 12 and having a predetermined length; and dampers 62 connected between the lower supporting rods 60 and the lower inner wall of the cabinet 2 for absorbing vibration.

Herein, the upper supporting rods 56 are bent to be connected to the upper side of the supporting plate 12 and positioned at the upper side of the first partition wall 52, and the buffering springs 58 are connected to the end portion of the upper supporting rods 56. Also, the lower supporting rods 60 are bent to be connected to the lower side of the supporting plate 12 and positioned at the lower side of the second partition wall 54, and the dampers 62 are connected to the end portion of the lower supporting rods 56.

In the drum type washing machine according to the present invention, a size of the drum can be maximized by fixing the tub in the cabinet, thereby increasing washing capacity of the drum without increasing a size of the cabinet.

Also, since the front surface of the tub is integrally formed at the inner wall of the cabinet and the gasket is installed between the rear surface of the tub and the supporting plate, a length of the drum can be increased and thus the washing capacity of the drum can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A drum type washing machine, comprising:
- a tub that receives washing fluid therein, the tub being provided in a horizontal direction;
- a drum rotatably installed in the tub, the drum being provided in a horizontal direction;
- a driving assembly, comprising:
  - a supporting plate that rotatably supports a rotational shaft of the drum, wherein the supporting plate forms at least a portion of a rear wall of the tub; and
  - a motor separately provided at a rear surface of the supporting plate to rotate the rotational shaft;
- a gasket that prevents washing fluid in the tub from leaking toward the driving assembly and allows the driving assembly to move relative to the tub, the gasket comprising a tub-connecting portion connected to a peripheral edge of the tub, a driving-assembly-connecting portion connected to the driving assembly, and a flexible curved portion which is flexibly extendible in a radial direction between the connecting portions; and
- a supporter that reduces vibration of the drum.

2. The drum type washing machine of claim 1, wherein the gasket further comprises a straight portion.

3. The drum type washing machine of claim 2, wherein the straight portion is slanted at an angle less than 45 degrees with respect to an axis normal to a rotational axis of the shaft.

4. The drum type washing machine of claim 3, wherein the straight portion is located radially inside the flexible curved portion.

5. The drum type washing machine of claim 4, wherein the straight portion is normal to the rotational axis of the shaft.

6. The drum type washing machine of claim 1, wherein the gasket further comprises straight portions arranged radially inside and outside the flexible curved portion.

7. The drum type washing machine of claim 1, wherein the flexible curved portion has less than three inflection points.

8. The drum type washing machine of claim 1, wherein the gasket has less than or equal to three turnings with respect to a rotational axis direction of the shaft.

9. The drum type washing machine of claim 1, wherein the gasket has less than or equal to two surfaces that cross a straight line connecting connection points of the flexible material to the tub and the driving assembly.

10. The drum type washing machine of claim 1, wherein an outer diameter of the gasket is larger than a diameter of the drum.

11. The drum type washing machine of claim 1, wherein the motor is co-axially connected to the rotational shaft.

12. The drum type washing machine of claim 1, wherein the supporting plate comprises a shaft-supporting portion at which the shaft is rotatably supported and an extended portion extending in a radial direction from the shaft-supporting portion, and wherein the gasket is connected to the extended portion.

13. The drum type washing machine of claim 12, wherein the extended portion comprises a circumferential surface at a radially outer portion thereof to which the gasket is connected.

14. The drum type washing machine of claim 12, wherein the extended portion comprises a recessed surface at a side opposite a drum-facing surface which is recessed toward the drum so as to provide a space for the motor.

15. The drum type washing machine of claim 1, wherein the supporter is attached to the driving assembly.

16. The drum type washing machine of claim 1, wherein the tub is supported more rigidly than the drum is.

17. The drum type washing machine of claim 1, wherein the supporter is connected to the supporting plate.

18. The drum type washing machine according to claim 1, wherein the supporting plate is disc-shaped.

19. A drum type washing machine, comprising:

a tub that receives washing fluid therein, the tub being provided in a horizontal direction;

a drum rotatably installed in the tub, the drum being provided in a horizontal direction;

a driving assembly comprising:

a supporting plate that rotatably supports a rotational shaft of the drum, wherein the supporting plate forms at least a portion of a rear wall of the tub; and a motor separately provided at the supporting plate to rotate the rotational shaft;

a gasket that prevents washing fluid in the tub from leaking toward the driving assembly and allows the driving assembly to move relative to the tub, the gasket comprising a tub-connecting portion connected to a peripheral edge of the tub, a driving-assembly-connecting portion connected to the driving assembly, and a flexible curved portion which is flexibly extendible in a radial direction between the connecting portions; and a supporter that reduces vibration of the drum.

20. The drum type washing machine according to claim 19, wherein the supporting plate is disc-shaped.

* * * * *